US006383726B1

(12) United States Patent
Arcus et al.

(10) Patent No.: US 6,383,726 B1
(45) Date of Patent: May 7, 2002

(54) METHOD FOR FORMULATING A PHOTOGRAPHIC DEVELOPER COMPOSITION AND PROCESS CONDITIONS TO OPTIMIZE DEVELOPED IMAGES FOR DIGITAL SCANNING

(75) Inventors: Robert A. Arcus, Penfield; Jeffrey L. Hall; John A. Weldy, both of Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/706,006

(22) Filed: Nov. 3, 2000

(51) Int. Cl.[7] ..... G03C 7/30
(52) U.S. Cl. ..... 430/357
(58) Field of Search ..... 430/357

(56) References Cited

U.S. PATENT DOCUMENTS

| | | | | |
|---|---|---|---|---|
| 3,287,125 | A | 11/1966 | Green et al. | |
| 3,778,464 | A | 12/1973 | Klemchuk | |
| 4,500,919 | A | 2/1985 | Schreiber | 358/78 |
| 4,897,339 | A | 1/1990 | Andoh et al. | 430/372 |
| 4,906,554 | A | 3/1990 | Ishikawa et al. | 430/467 |
| 5,094,937 | A | 3/1992 | Morimoto | 430/485 |
| 5,110,985 | A | 5/1992 | Hayakawa et al. | 562/571 |
| 5,153,112 | A | 10/1992 | Yoshida et al. | 430/428 |
| 5,262,563 | A | 11/1993 | Morimoto | 562/104 |
| 5,267,030 | A | 11/1993 | Giorgianni et al. | 430/527 |
| 5,278,034 | A | 1/1994 | Ohki et al. | 430/440 |
| 5,344,750 | A | 9/1994 | Fujimoto et al. | 430/434 |
| 5,375,000 | A | 12/1994 | Ray et al. | 358/506 |
| 5,436,118 | A | 7/1995 | Carli et al. | 430/400 |
| 5,455,146 | A | 10/1995 | Nishikawa et al. | 430/383 |
| 5,698,379 | A | 12/1997 | Bohan et al. | 430/359 |
| 5,744,288 | A | 4/1998 | Buchanan et al. | 430/383 |
| 5,747,228 | A | 5/1998 | Bohan et al. | 430/380 |
| 5,804,356 | A | 9/1998 | Cole et al. | 430/359 |
| 5,827,635 | A | 10/1998 | Cole | 430/372 |
| 5,830,625 | A | 11/1998 | Hirano | 430/435 |
| 5,830,627 | A | 11/1998 | Nakai et al. | 430/505 |
| 5,840,470 | A | 11/1998 | Bohan et al. | 430/359 |
| 6,048,674 | A | 4/2000 | McInerney et al. | 430/383 |

FOREIGN PATENT DOCUMENTS

| | | |
|---|---|---|
| EP | 0 434 097 A1 | 6/1991 |
| EP | 0 488 737 A1 | 6/1992 |
| EP | 0 530 921 A1 | 3/1993 |
| EP | 0 624 028 A1 | 11/1994 |
| JP | 11212227 A | 8/1999 |
| JP | 11223909 A | 8/1999 |

OTHER PUBLICATIONS

Research Disclosure, publication No. 36544, pp. 501–541, Sep. 1994, a publication of Kenneth Mason Publications Ltd., Dudley House, 12 North Street, Emsworth, Hampshire P010 7DQ, England.

*Primary Examiner*—Hoa Van Le
(74) *Attorney, Agent, or Firm*—Sarah Meeks Roberts

(57) ABSTRACT

A method for deriving a color negative film developer composition and processing conditions for developing a photographic film image which is optimized for subsequent digital scanning and digital image file manipulation, which allows for optimum rapid development processing of the film is disclosed. The process includes identifying at least one independent variable that has a first order effect on the density of at least one of the red, green, and blue dye images of the developed image, selecting a desired range of values for the independent variables identified, formulating an experimental design that includes desired independent variables over the desired range of values, performing the experiment to obtain statistically significant values for desired dependent variables, applying the values to a mathematical model capable of providing a formula for optimizing responses to the dependent variables, and using the formula to identify desired optimal developer composition and processing conditions resulting in an developed image in which the subsequent required digital scanning and digital image file manipulation is reduced.

19 Claims, 1 Drawing Sheet

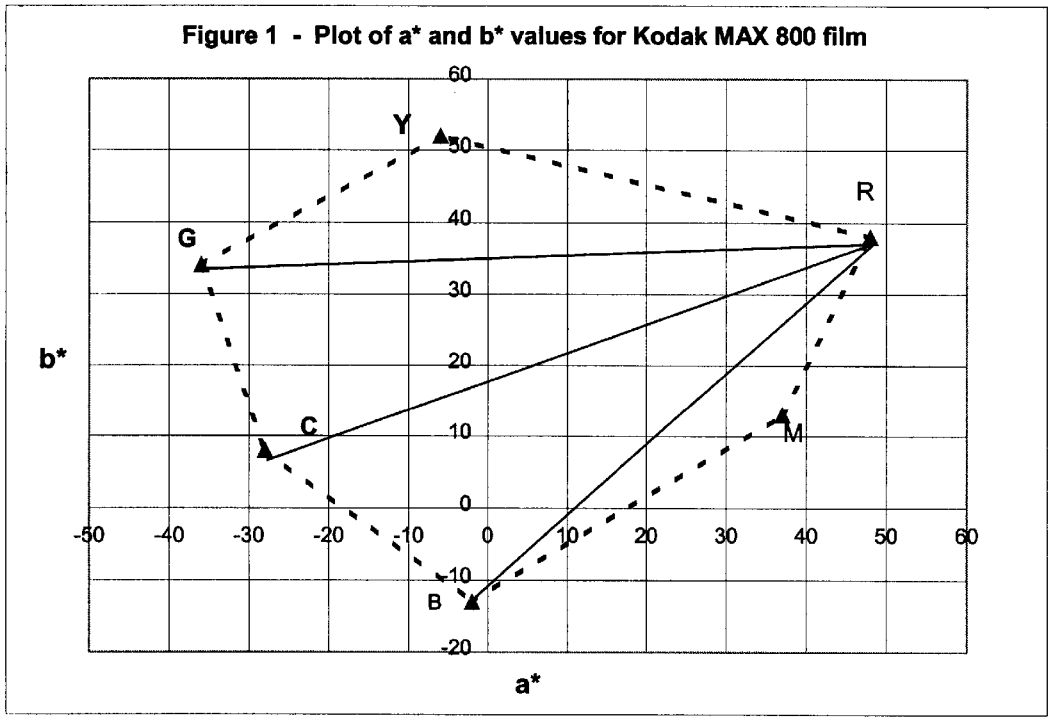
Figure 1 - Plot of a* and b* values for Kodak MAX 800 film
b*
a*
Y
R
G
C
M
B
60
50
40
30
20
10
0
-10
-20
-50
-40
-30
-20
-10
0
10
20
30
40
50
60

METHOD FOR FORMULATING A PHOTOGRAPHIC DEVELOPER COMPOSITION AND PROCESS CONDITIONS TO OPTIMIZE DEVELOPED IMAGES FOR DIGITAL SCANNING

FIELD OF THE INVENTION

The present invention relates to a method for formulating a photographic developer composition using rapid processing of silver halide color negative films and process conditions to optimize developed images for digital manipulation to provide color display images with desired aim tone and color reproduction and photographic developer compositions formulated therefrom.

BACKGROUND OF THE INVENTION

Production of photographic color images from light sensitive materials basically consists of two processes. First, color negative images are generated by light exposure of camera speed light sensitive films, that are sometimes called "originating" elements because the images are originated therein by the film user (that is, "picture taker"). These negative images are then used to generate positive images in light sensitive materials. These latter materials are sometimes known as "display" elements and the resulting images may be known as "prints" when coated on reflective supports or "films" when coated on nonreflective supports.

The light sensitive materials are processed in automated processing machines through several steps and processing solutions to provide the necessary display images. Traditionally, this service has required a day or more to provide the customer with the desired prints. In recent years, customers have wanted faster service, and in some locations, the time to deliver this service has been reduced to within an hour. Reducing the processing time to within a few minutes is the ultimate desire in the industry. To do this, each step must be shortened.

Reduction in processing time of the "display" elements or color photographic papers has been facilitated by a number of recent innovations, including the use of predominantly silver chloride emulsions in the elements, and various modifications in the processing solutions and conditions so that each processing step is shortened. In some processes, the total time can be reduced to less than two minutes, and even less than 90 seconds.

Color negative films generally comprise little or no silver chloride in their emulsions, and have silver bromide as the predominant silver halide. More typically, the emulsions are silver bromoiodide emulsions with silver iodide levels up to several mol percent. Such films have required these types of emulsions because emulsions containing high silver chloride have generally had insufficient light sensitivity to be used as camera speed materials although they have the advantage of being rapidly processed without major changes to the color developer solution.

To shorten the processing time, specifically the color development time, of films containing silver bromoiodide emulsions, more active color developer solutions are needed. Various attempts have been made to increase color developer activity by increasing the pH, increasing the color developing agent concentration, decreasing the halide ion concentration, or increasing temperature. However, when these changes are made, the stability of the solution and the photographic image quality are often diminished.

For example, when the development temperature is increased from the conventional 37.8° C., and the color developer solution is held (or used) in the processing tanks for extended periods of times, silver bromoiodide elements processed with such solutions often exhibit unacceptably high density in the unexposed areas of the elements, that is unacceptably high Dmin.

Keeping of processing solutions for extended periods of time at high temperature for use in rapid high temperature color development of silver bromoiodide films has been accomplished by the use of a specific hydroxylamine antioxidant, as described in U.S. Ser. No. 08/590,241 (filed Jan. 23, 1996, by Cole).

Various methods have been proposed for overcoming problems encountered in processing high chloride silver halide emulsion-containing elements, but little has been done to address the problems for rapid processing of silver bromoiodide elements. For example, novel antioxidants have been developed to stabilize developer solutions (e.g., U.S. Pat. No. 4,897,339 of Andoh et al, U.S. Pat. No. 4,906,554 of Ishikawa et al, and U.S. Pat. No. 5,094,937 of Morimoto). High silver chloride emulsions have been doped with iridium compounds, as described in EP-A-0 488 737. Dyes have been developed to eliminate dye remnants from rapid processing as described in U.S. Pat. No. 5,153,112 of Yoshida et al. Novel color developing agents have been proposed for rapid development as described in U.S. Pat. No. 5,278,034 of Ohki et al.

All of the foregoing methods have been designed for processing high silver chloride photographic papers, and have not been shown to be effective in processing color negative silver bromoiodide films.

U.S. Pat. No. 5,344,750 (Fujimoto et al) describes a method for processing elements containing silver iodobromide emulsions that is allegedly rapid, including color development for 40–90 seconds. The potential problems of low sensitivity and high fog in rapidly developed elements is asserted to be overcome by using a color development temperature and an amount of color developing agent and bromide ion in the color developer that are determined by certain mathematical relationships. That is, the amount of color developing agent and bromide ion is considered to be related, and the development temperature and bromide ion concentration are related, both relationships being expressed in mathematical equations.

It has been found, however, that even when the relationships described in U.S. Pat. No. 5,344,750 are followed and color negative films are color developed in short times (less than 90 seconds), the color balance of the three color records cannot be maintained through a useful exposure range. By "color balance" is meant the display image, produced from a neutral exposure of a color negative image, will have a neutral color rendition throughout the useful exposure range. The color record imbalance is caused by the difficulty of getting sufficient development in the color record next to the support without forcing the topmost color record to be overdeveloped, resulting in high fog, contrast or Dmax. This color imbalance in the color records of a multilayer photographic color film cannot be corrected using conventional optical printing of the color negative onto a color display element. Thus, very short development times of the color negative films cannot readily provide negative images in the "originating" color negative film capable of providing display images having acceptable tone scale and color reproduction. This limitation is a serious obstacle to the development of imaging systems with very rapid access to the final photographic print.

U.S. Pat. No. 5,455,146 (Nishikawa et al) describes a method for forming color images in photographic elements containing silver iodobromide emulsions that is allegedly rapid and includes color development for 30–90 seconds. The potential problems of gamma imbalance are asserted to be overcome by controlling the morphology of the light sensitive silver halide emulsion grains, the thickness and swell rate of the photographic film, and the ratio of 2-equivalent color couplers to total couplers in the red-sensitive silver halide emulsion layer. However, the methods described in this patent require a color negative film to be specifically constructed with the noted features to correct gamma imbalance, but they do not correct the color imbalance produced by rapidly developing commercially available color negative films that do not have the noted features. In other words, the method of gamma correction requires a specific film and cannot be applied to any film on the market.

After a color negative film has been chemically processed in the manner described above, it can be scanned to create a digital representation of the image. The most common approach to scanning an image is to record the transmission of a light beam, point-by-point or line-by-line. In color photography, blue, green and red scanning beams are modulated by the yellow, magenta and cyan image dyes, respectively. In a variant color scanning approach, the blue, green and red scanning beams are combined into a single white scanning beam modulated by the image dyes that is read through blue, green and red filters to create separate color records. These records can then be read into any convenient memory medium (for example, an optical disk). Systems in which the image is passed through an intermediate device, such as a scanner or computer, are often referred to as "hybrid" imaging systems.

A hybrid imaging system must include a method for scanning or otherwise measuring the individual picture elements of the photographic media, which serve as input to the system, to produce image-bearing signals. In addition, the system must provide a means for transforming the image-bearing signals into an image representation or encoding that is appropriate for the particular uses of the system.

Hybrid imaging systems have numerous advantages because they are free of many of the classical constraints of photographic embodiments. For example, systematic manipulation (for example, image reversal, and hue and tone alteration) of the image information, that would be cumbersome or impossible to accomplish in a controlled manner in a photographic element, is readily achieved. The stored information can be retrieved from memory to modulate light exposures necessary to recreate the image as a photographic negative, slide or print at will. Alternatively, the image can be viewed on a video display or printed by a variety of techniques beyond the bounds of classical photography, such as electrophotography; ink jet printing, dye diffusion printing and other techniques known in the art.

U.S. Pat. No. 4,500,919 (Schreiber) describes an image reproduction system in which an electronic reader scans an original color image and converts it to electronic image-bearing signals. A computer workstation and an interactive operator interface, including a video monitor, permit an operator to edit or alter the image-bearing signals by means of displaying the image on the monitor. The workstation causes the output device to produce an inked output corresponding to the displayed image. The image representation or encoding is meant to represent the colorimetry of the image being scanned. Calibration procedures are described for transforming the image-bearing signals to an image representation or encoding so as to reproduce the colorimetry of a scanned image on the monitor and to subsequently reproduce the colorimetry of the monitor image on the inked output.

However, representation of the image recorded by the film is not necessarily the desired final image. U.S. Pat. No. 5,375,000 (Ray et al) teaches that the scanned image can be modified with a function representing the inverse of the film characteristic curve [density vs. log(exposure)] to obtain a representation of the image more closely representing the original image log(exposure). This approach could be used to restore the mismatched gammas in the negative film caused by rapid processing. However, modem color negative films are also designed to have chemical interactions (interimage) between the different color records to achieve a desired color position, and not necessarily a perfect rendition of the original scene. These interactions are dependent upon processing time and will produce color errors in a rapidly processed film. These changes in interimage cannot be corrected using conventional color correction tools but can be corrected when the image information has been transformed into a digital representation of the image density.

EP-A-0 624 028 (Giorgianni et al) describes an imaging system in which image-bearing signals are converted to a different form of image representation or encoding, representing the corresponding calorimetric values that would be required to match, in the viewing conditions of a uniquely defined reference viewing environment, the appearance of the rendered input image as that image would appear, if viewed in a specific input viewing environment. The described system allows for input from disparate types of imaging media, such as photographic negatives as well as transmission and reflection positives. The image representation or encoding of that system is meant to represent the color appearance of the image being scanned (or the rendered color appearance computed from a negative being scanned), and calibration procedures are described so as to reproduce that appearance on the monitor and on the final output device or medium.

U.S. Pat. No. 5,267,030 (Giorgianni et al) describes a method for deriving, from a scanned image, recorded color information that is substantially free of color alterations produced by the color reproduction properties of the imaging element. In this reference, the described system computationally removes the effects of media-specific signal processing as far as possible, from each input element used by the system. In addition, the chromatic interdependencies introduced by the secondary absorptions of the image-forming dyes, as measured by the responsivities of the scanning device, are also computationally removed. Use of the methods described in this reference transforms the signals measured from the imaging element to the exposures recorded from the original image.

Recently, there has been an increased interest in the use of conventional color film systems as the source of digital image files via scanning of reversal and color negative films. The chemical dye image in a color film provides several benefits to the customer that are not readily attainable in a digital camera system. For one, film as the image storage medium is human readable and therefore is hardware independent for interpretation of the image. The image can be interrogated and manipulated via numerous analog devices (e.g., printing onto color photographic paper or projecting on a screen) and digital scanning devices, to provide both soft and hard copy of the image. The image is archival if the chemical process was performed correctly and the processed film is stored under appropriate conditions. The color records of the original film are self-registered because film features multiple photosensitive layers that capture the scene image. All three colors records are recorded in high fidelity over the entire area of the image. No interpolation is required to determine missing color information, as is the case in single sensor digital capture systems employing CCD or CMOS sensors which contain only one photosensitive layer segmented with different colors. There is no spatial aliasing of the information owing to the spatially sampled signals recorded by digital sensors. The archival film dye image can be repetitively scanned many times, to give the same high fidelity image information. The image is not lost or degraded with the first scan, or subsequent scans.

In addition, there is the need for more rapid chemical processing of the film negative for rapid retrieval of the film image into a digital image file. In general, the chemical development process must give an image on the negative that is of low D-min, a reasonable contrast, and a D-max at or below 3.0 density. These attributes facilitate the digital scanning of the film negative to provide a digital image file. In addition, the light capturing capability of the film, or photographic speed cannot be compromised. Obviously, the digital image file can be further optimized via software manipulation and output to a wide variety of soft or hard copy devices.

Furthermore, it is preferred that rapid chemical development processes provide red, green and blue densitometric results that can be gamma and color adjusted by means that can include both channel independent (e.g. one-dimensional look up tables LUTs) channel interdependent (e.g. matrices) means to provide a "corrected" digital image file. Unfortunately, while gamma and color can be adjusted as described above, the more gain applied (by both channel independent and channel interdependent means) the more noise (originating in the original film and/or from the scanning process) will be amplified. Therefore, it is desirable to optimize the photo process to produce results that minimize the subsequent amplification required to restore the rapid chemical developed film to film that was photoprocessed through conventional processes.

Recent patents by Cole and Bohan (U.S. Pat. No. 5,804,356) and also Bohan, Buchanan, and Szajewski (U.S. Pat. No. 5,693,379 and U.S. Pat. No. 5,840,470) which are herein incorporated by reference in their entirety, respectively provide possible avenues to obtaining digital image files from scanned, rapidly developed, film negatives. U.S. Pat. No. 5,804,356 is deficient in that it provides a such wide range of processing chemical concentrations and processing conditions such that a person of ordinary skill in the art would not be led to those concentrations and conditions that produce images optimized for digital scanning and subsequent manipulation.

All three of the above mentioned patents fail to provide a method to optimize the-chemical developer to provide the best dye image (i.e. image requiring the minimum amount of amplification).

The prior art lacks a method to rapidly chemically process a color film that provides a superior dye image for digital scanning. Such a method would include formation of a dye image on the film that is of low D-min value and suitable contrast and D-max value, which would facilitate the digital scanning of the film negative to provide a digital image file. Such a method would provide a means for designing the chemical process to minimize the need for amplification of the digitally scanned image, while insuring that the chemical process is designed to maintain the photographic speed of the film. Most importantly, there is a need for a quantitative method to evaluate the rapid developer/process for the attainment of an optimal digital image file. Thus, there remains a need for a process for providing color display images from images originated in commercially available silver bromoiodide films which require minimal correcting of color imbalances that occur in the color records from the rapidity of the film processing.

SUMMARY OF THE INVENTION

The problems described above have been overcome with a method for deriving a color negative film developer composition and processing conditions for developing a photographic image which is optimized for subsequent digital scanning and digital image file manipulation and which allows for optimum rapid development processing of the film. The method includes identifying at least one independent variable that has a first order effect on the density of at least one of the red, green, and blue dye images of the developed image. A range of values is selected for the independent variables identified. Then an experimental design is formulated that includes desired independent variables over the desired range of values. The experiment is then performed to obtain statistically significant values for the desired dependent variables. The values are applied to a mathematical model capable of providing a formula for optimizing responses to the dependent variables. The formula is used to identify desired optimal developer composition and processing conditions resulting in a developed image in which the subsequent required digital scanning and digital image file manipulation is reduced.

In this manner, a color negative film developer composition, suitable for rapid development processing and optimized for subsequent digital scanning and digital image file manipulation, can be prepared.

The present invention also provides a method for providing a color display image including developing an imagewise exposed color silver halide negative working film having at least two color records, with a color developer solution composition and under development process conditions derived in accordance with the above method. The developed film is scanned to form density representative signals for the at least two color records. Then the density representative signals are digitally manipulated to correct either or both interimage interaction and gamma mismatches among the at least two color records to produce a digital record providing a display image having desired aim color and tone scale reproduction, such that the amount of digital manipulation is minimized. The present invention is also directed to a color or monotone image prepared from this digital record.

BRIEF DESCRIPTION OF THE DRAWINGS

FIG. 1 is a plot of a* and b* values for Kodak MAX 800 film.

DETAILED DESCRIPTION OF THE INVENTION

The present invention is particularly useful for processing camera speed negative photographic films containing silver bromoiodide emulsions. Generally, the iodide ion content of such silver halide emulsions is at least 0.5 mol % and less than about 40 mol % (based on total silver), preferably from about 0.05 to about 10 mol %, and more preferably, from about 0.5 to about 6 mol %. Substantially the remainder of the silver halide is silver bromide. There can be very minor amounts of silver chloride (less than 5 mol %, and preferably less than 2 mol %).

The emulsions can be of any regular crystal morphology (such as cubic, octahedral, cubooctahedral or tabular as are known in the art) or mixtures thereof, or irregular morphology (such as multiple twinning or rounded). For tabular grains, preferably, the emulsions have as aspect ratio greater than about 5 and preferably greater than about 8. The size of the tabular grain, expressed as an equivalent circular diameter, is determined by the required speed for the applied use, but is preferably from about 0.06 to about 10 mm, and more preferably, from about 0.1 to about 5 mm.

Preferably, the elements have at least two separate light sensitive emulsion layers, at least one being in each of two different color records. More preferably, there are three color records, each having at least one silver bromoiodide emulsion as described herein.

Such elements generally have a camera speed defined as an ISO speed of at least 25, preferably an ISO speed of at least 50 and more preferably, an ISO speed of at least 100.

The speed or sensitivity of color negative photographic materials is inversely related to the exposure required to enable the attainment of a specified density above fog after processing. Photographic speed for color negative films with a gamma of about 0.65 has been specifically defined by the American National Standards Institute (ANSI) as ANSI Standard Number PH 2.27-1979 (ASA speed) and relates to the exposure levels required to enable a density of 0.15 above fog in the green light sensitive and least sensitive recording unit of a multicolor negative film. This definition conforms to the International Standards Organization (ISO) film speed rating. For the purpose of this invention, if the film gamma is substantially different from 0.65, the ISO speed is calculated by linearly amplifying or deamplifying the gamma vs. log E(exposure) curve to a value of 0.65 before determining the sensitivity.

The layers of the photographic elements can have any useful binder material or vehicle known in the art, including various types of gelatins and other colloidal materials (or mixtures thereof). One useful binder material is acid processed gelatin that can be present in any layer in any suitable amount.

The photographic elements processed in the practice of this invention are multilayer color elements having at least two color records. Multilayer color elements typically contain dye image-forming units (or color records) sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be used as well as conventional supports. Preferably, transparent supports are employed in the films as are well known in the art.

Considerable details of element structure and components, and suitable methods of processing various types of elements are described in Research Disclosure, noted below. Included within such teachings in the art is the use of various classes of cyan, yellow and magenta color couplers that can be used with the present invention. In particular, the present invention can be used to process photographic elements containing pyrazolotriazole magenta dye forming couplers.

Representative color negative films that can be processed using the present invention include, but are not limited to, KODAK ROYAL GOLD® films, KODAK GOLD® films, KODAK PRO GOLD™ films, KODAK FUNTIME™ films, KODAK EKTAPRESS PLUS™ films, EASTMAN EXR™ films, KODAK ADVANTIXT™ films, FUJI SUPER G Plus films, FUJI SMARTFILM™ products, FUJICOLOR NEXIA™, KONICA VX films, KONICA SRG3200 film, 3M SCOTCH® ATG films, and AGFA HDC and XRS films.

Further details of such elements, their emulsions and other components are well known in the art, including Research Disclosure, publication 36544, pages 501–541 (Sep. 1994). Research Disclosure is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "Research Disclosure".

The films described herein are color developed using a color developer solution having a pH of from about 9 to about 12 (preferably from about 9.5 to about 11.0). The color developer solution pH can be adjusted with acid or base to the desired level, and the pH can be maintained using any suitable buffer having the appropriate acid dissociation constants, such as carbonates, phosphates, borates, tetraborates, phosphates, glycine salts, leucine salts, valine salts, proline salts, alanine salts, aminobutyric acid salts, lysine salts, guanine salts and hydroxybenzoates or any other buffer known in the art to be useful for this purpose.

The color developer also includes one or more suitable color developing agents, in an amount of from about 0.01 to about 0.1 mol/l, and preferably at from about 0.017 to about 0.07 mol/l. Any suitable color developing agent can be used, many of which are known in the art, including those described in Research Disclosure, noted above. Particularly useful color developing agents include but are not limited to, aminophenols, p-phenylenediamines (especially N,N-dialkyl-p-phenylenediamines) and others that are well known in the art, such as EP-A 0 434 097A1 (published Jun. 26, 1991) and EP-A 0 530 921A1 (published Mar. 10, 1993). It may be useful for the color developing agents to have one or more water-solubilizing groups.

Bromide ion may be included in the color developer in an amount of up to about 0.02 mol/l, and preferably from about 0.01 to about 0.1 5 mol/l. Bromide ion can be provided in any suitable salt such as sodium bromide, lithium bromide, potassium bromide, ammonium bromide, magnesium bromide, or calcium bromide.

Preferably, the color developer also includes a small amount of iodide ion from a suitable iodide salt, such as lithium iodide, potassium iodide, sodium iodide, calcium iodide, ammonium iodide or magnesium iodide. The amount of iodide ion is generally at least about $5\times10^{-7}$ mol/l, and preferably from about $5\times10^{-7}$ to about $2\times10^{-5}$ mol/l.

In addition to the color developing agent, bromide salts and buffers, the color developer can contain any of the other components commonly found in such solutions, including but not limited to, preservatives (also known as antioxidants), metal chelating agents (also known as metal sequestering agents), antifoggants, optical brighteners, wetting agents, stain reducing agents, surfactants, defoaming agents, auxiliary developers (such as those commonly used in black-and-white development), development accelerators, and water-soluble polymers (such as a sulfonated polystyrene).

Useful preservatives include, but are not limited to, hydroxylamines, hydroxylamine derivatives, hydroxamic acid, hydrazines, hydrazides, phenols, hydroxyketones, aminoketones, saccharides, sulfites, bisulfites, salicylic acids, alkanolamines, alpha-amino acids, polyethyleneimines, and polyhydroxy compounds. Mixtures of preservatives can be used if desired. Hydroxylamine or hydroxylamine derivatives are preferred.

Antioxidants particularly useful in the practice are represented by the formula:

R—L—N(OH)—L'—R' wherein L and L' are independently substituted or unsubstituted alkylene of 1 to 8 carbon atoms (such as methylene, ethylene, n-propylene, isopropylene, n-butylene 1,1-dimethylethylene, n-hexylene, n-octylene and t-butylene), or substituted or unsubstituted alkylenephenylene of 1 to 3 carbon atoms in the alkylene portion (such as benzylene, dimethylenephenylene, and isopropylenephenylene).

The alkylene and alkylenephenylene groups can also be substituted with up to 4 substituents that do not interfere with the stabilizing effect of the molecule, or the solubility of the compound in the color developer solution. Such substituents must be compatible with the color developer components and must not negatively impact the photographic processing system. Such substituents include but are not limited to, alkyl of 1 to 6 carbon atoms, fluoroalkyl groups of 1 to 6 carbon atoms, alkoxy of 1 to 6 carbon atoms, phenyl, hydroxy, halo, phenoxy, alkylthio of 1 to 6 carbon atoms, acyl groups, cyano, or amino.

In the noted formula, R and R' are independently hydrogen, carboxy, sulfo, phosphono, carbonamido, sulfonamido, hydroxy, alkoxy (1 to 4 carbon atoms) or other acid groups, provided that at least one of R and R' is not hydrogen. Salts of the acid groups are considered equivalents in this invention. Thus, the free acid forms of the hydroxylamines can be used, as well as the organic or inorganic salts of the acids, such as the alkali metal, pyridinium, tetraethylammonium, tetramethylammonium and ammonium salts. The sodium and potassium salts are the preferred salts. In addition, readily hydrolyzable ester equivalents can also be used, such as the methyl and ethyl esters of the acids. When L or L' is alkylenephenylene, the carboxy, sulfo or phosphono group is preferably at the para position of the phenylene, but can be at other positions if desired. More than one carboxy, sulfo or phosphono group can be attached to the phenylene radical.

Preferably, one or both of R and R' are hydrogen, carboxy or sulfo, with hydrogen and sulfo (or salts or readily hydrolyzable esters thereof) being more preferred. Most preferably, R is hydrogen and R' is sulfo (or a salt thereof).

Preferably, L and L' are independently substituted or unsubstituted alkylene of 3 to 6 carbon atoms (such as n-propyl, isopropyl, n-butyl, sec-butyl, t-butyl, n-pentyl, 1-methylpentyl and 2-ethylbutyl), or substituted or unsubstituted alkylenephenylene having 1 or 2 carbon atoms in the alkylene portion (such as benzyl, and dimethylenephenyl).

More preferably, at least one, and optionally both, of L and L' is a substituted or unsubstituted alkylene group of 3 to 6 carbon atoms that is branched at the carbon atom directly attached (that is, covalently bonded) to the nitrogen atom of the hydroxylamine molecule. Such branched divalent groups include, but are not limited to, isopropylene, sec-butylene, t-butylene, sec-pentylene, t-pentylene, sec-hexylene and t-hexylene. Isopropylene is most preferred.

In one embodiment, L and L' are the same. In other and preferred embodiments, they are different. In the latter embodiment, L is more preferably a branched alkylene as described above, and L' is a linear alkylene of 1 to 6 carbon atoms (such as methylene, ethylene, n-propylene, n-butylene, n-pentylene and n-hexylene).

Representative hydroxylamine derivatives useful of the noted formula include, but are not limited to, N-isopropyl-N-(2-ethanesulfonic acid)hydroxylamine, N,N-bis(propionic acid)hydroxylamine, N,N-bis(2-ethanesulfonic acid)hydroxylamine, N-isopropyl-N-(n-propylsulfonic acid)hydroxylamine, N-2-ethanephosphonic acid-N-(propionic acid)hydroxylamine, N,N-bis(2-ethanephosphonic acid)hydroxylamine, N-sec-butyl 2-ethanesulfonic acid)hydroxylamine, N,N-bis(sec-butylcarboxylic acid)hydroxylamine, N-methyl-N-(p-carboxylbenzyl)hydroxylamine, N-isopropyl-N-(p-carboxylbenzyl)hydroxylamine, N,N-bis(p-carboxylbenzyl)hydroxylamine, N-methyl-N-(p-carboxyl-m-methylbenzyl)hydroxylamine, N-isopropyl-N-(p-sulfobenzyl)hydroxylamine, N-ethyl-N-(p-phosphonobenzyl)hydroxylamine, N-isopropyl-N-(2-carboxymethylene-3-propionic acid)hydroxylamine, N-isopropyl-N-(2-carboxyethyl)hydroxylamine, N-isopropyl-N-(2,3-dihydroxypropyl)hydroxylamine, and alkali metal salts thereof.

The hydroxylamine derivatives described herein as useful antioxidants can be readily prepared using published procedures, such as those described in U.S. Pat. No. 3,287,125, 3,778,464, 5,110,985 and 5,262,563, all incorporated herein by reference for the synthetic me general synthetic procedure for preparing sulfo-substituted hydroxylamine derivatives comprises reacting an N-alkylhydroxylamine with a vinylsulfonate in a suitable solvent (such as water, an alcohol, tetrahydrofuran or methyl ethyl ketone). For the alkali metal salts of vinylsulfonates, water is the best solvent. In cases where the hydroxylammonium salt is available, an equivalent of a base must be used to liberate the free N-alkylhydroxylamine.

The antioxidant described herein is included in the color developer composition useful in this invention in an amount of at least about 0.001 mol/l, and in a preferred amount of from about 0.001 to about 0.5 mol/l. A most preferred amount is from about 0.005 to about 0.5 mol/l. More than one antioxidant can be used in the same color developer composition if desired, but preferably, only one is used.

The elements are typically exposed to suitable radiation to form a latent image and then processed to form a visible dye image. Processing includes the step of color development in the presence of a color developing agent to reduce developable silver halide and to oxidize the color developing agent. Oxidized color developing agent in turn reacts with a color-forming coupler to yield a dye.

Optionally but preferably, partial or total removal of silver and/or silver halide is accomplished after color development using conventional bleaching and fixing solutions (i.e., partial or complete delivering steps), or fixing only to yield both a dye and silver image. Alternatively, all of the silver and silver halide can be left in the color developed element. One or more conventional washing, rinsing or stabilizing steps can also be used, as is known in the art. These steps are typically carried out before scanning and digital manipulation of the density representative signals.

Development is carried out by contacting the element for up to about 90 seconds (preferably from about 30 to about 90 seconds, and more preferably from about 40 to about 90 seconds) at a temperature above 40° C., and at from about 45 to about 65° C. in suitable processing equipment, to produce the desired developed image.

The overall processing time (from development to final rinse or wash) can be from about 50 seconds to about 4 minutes. Shorter overall processing times, that is, less than about 3 minutes, are desired for processing photographic color negative films according to this invention.

Processing according to the present invention can be carried out using conventional deep tanks holding processing solutions or automatic processing machines. Alternatively, it can be carried out using what is known in the art as "low volume thin tank" processing systems, or LVTT, which have either a rack and tank or automatic tray design. Such processing methods and equipment are described, for example, in U.S. Pat. No. 5,436,118 (Carli et al) and publications noted therein.

The residual error in photographic responses of photographic films that are processed as described above, is corrected by transforming the photographic color negative image to density representative digital signals and applying correction values to those digital signals. The term "correction value" is taken to refer to a broad range of mathematical operations that include, but are not limited to, mathematical constants, matrices, linear and non-linear mathematical relationships, and single and multi-dimensional look-up-tables (LUT's).

The term "density representative digital signals" refers to the electronic record produced by scanning a photographic image point-by-point, line-by-line, or frame-by-frame, and measuring the -log (transmission) of light beams, that is blue, green and red scanning beams that are modulated by the yellow, magenta and cyan dyes in the film negative. In a variant color scanning approach, the blue, green and red scanning beams are combined into a single white scanning beam that is modulated by the dyes, and is read through red, green and blue filters to create three separate digital records. Scanning can be carried out using any conventional scanning device.

The records produced by image dye modulation can then be read into any convenient memory medium (for example, an optical disk) for future digital manipulation or used immediately to produce a corrected digital record capable of producing a display image having desired aim color and tone scale reproduction. The aim color and tone scale reproduction may differ for a given photographic film image or operator. The advantage of the invention is that whatever the "aim", it can be readily achieved using the present invention.

The corrected digital signals (that is, digital records) can be also forwarded to an output device to form the display image. The output device may take a number of forms such as a silver halide film or paper writer, thermal printer, electrophotographic printer, ink jet printer, CRT display, CD disc or other types of storage and output display devices.

In one embodiment of this invention, the density representative digital signals obtained from scanning the high temperature, rapidly processed film ($R_{Ti}$, $G_{Ti}$, $B_{Ti}$) are compared with the density representative digital signals ($R_{oi}$, $G_{oi}$, $B_{oi}$) obtained from standard processing of the same film having identical exposures, and a correction factor is determined. The standard processing conditions could be those used in the commercial Process C-41 (e.g., color development for 3 minutes, 15 seconds, bromide ion level of 0.013 mol/l, color developing agent level of 0.015 mol/l, temperature of 37.8° C., and a pH of 10.0) for processing color negative films.

In its simplest form, the correction factor can be derived from two exposures that are selected to exceed the minimum exposure required to produce a density above Dmin and are less than the minimum exposure required to achieve Dmax. Preferably, these exposures are selected to be as different as possible while falling within the region that exhibits a linear density response to log exposure. Preferably, the exposures are also neutral. Based on the density representative digital signals obtained for the two exposures in both the rapidly processed, high temperature film according to this invention, and the standard temperature and time processed film, a simple gamma correction factor may be obtained.

Equations 1–3 below are used to calculate the correction factor for the red, green and blue color records respectively:

$$\Delta\gamma_R = \frac{R_{OiH} - R_{OiL}}{R_{TiH} - R_{TiL}} \tag{1}$$

$$\Delta\gamma_G = \frac{G_{OiH} - G_{OiL}}{G_{TiH} - G_{TiL}} \tag{2}$$

$$\Delta\gamma_B = \frac{B_{OiH} - B_{OiL}}{B_{TiH} - B_{TiL}} \tag{3}$$

In the above equations the subscript H and L refer to the high and low exposure levels respectively. In this approach, the density representative digital signals for the high temperature, rapidly processed negative ($R_{Ti}$, $G_{Ti}$, $B_{Ti}$) are multiplied by ($\Delta_{\gamma R}$, $\Delta_{\gamma G}$, $\Delta_{\gamma B}$) to obtain the corrected density representative signals ($R_{pi}$, $G_{pi}$, $B_{pi}$).

An improved correction factor can be obtained by comparing additional density representative digital signals over a broad range of exposures. Either a set of 3 one-dimensional look-up tables could be derived or, to achieve additional accuracy, a multidimensional look-up table could be used. In practice these approaches would use the density representative digital signal(s) ($RT_i$, $G_{Ti}$, $B_{Ti}$) for each pixel of an image as an index into the look-up tables to find a new density representative signal(s) ($R_{pi}$, $G_{pi}$, $B_{pi}$) that would more closely match that set of density representative digital signals ($R_{oi}$, $G_{oi}$, $B_{oi}$) which would be achieved using a standard temperature, standard time processed negative.

Another variant of this approach would be to calculate the functional relationship between ($R_{Ti}$, $G_{Ti}$, $B_{Ti}$) and ($R_{oi}$, $G_{oi}$, $B_{oi}$) as $$f((R_{oi}, G_{oi}, B_{oi})) = g((R_{Ti}, G_{Ti}, B_{Ti}))$$

and to use this equation to calculate corrected density representative digital signals ($R_{pi}$, $G_{pi}$, $B_{pi}$) which more closely match that set of density representative digital signals ($R_{oi}$, $G_{oi}$, $B_{oi}$) which would be achieved by a standard temperature, standard time processed negative. Additional variations on this approach could include a matrix, derived by regressing the density representative digital signals achieved by the high temperature, rapidly processed negative, ($RT_i$, $G_{Ti}$, $B_{Ti}$) and the desired density representative digital signals obtained from a standard temperature, standard time processed film, ($R_{oi}$, $G_{oi}$, $B_{oi}$). The matrix could also be used in combination with a set of look-up tables. The corrected density representative digital signals ($R_{pi}$, $G_{pi}$, $B_{pi}$) achieved by these approaches could then be further manipulated and/or enhanced digitally, displayed on a monitor, transmitted to a hardcopy device, or stored for use at a later date.

In another embodiment of the invention, the density representative digital signals from a high temperature, rapidly processed film ($RT_i$, $G_{Ti}$, $B_{Ti}$) are obtained for a well manufactured, correctly stored and processed film exposed to a series of patches that differ in color and intensity, and are stepped in intensity over the exposure scale. These density representative digital signals are used in combination with the exposure information for the different patches to generate an interimage correction matrix ($MAT_{ii}$).

$$MAT_{ii} = \begin{vmatrix} a_1 & a_4 & a_5 \\ a_7 & a_2 & a_6 \\ a_8 & a_9 & a_3 \end{vmatrix}$$

This matrix describes the interaction between the three color records where development in one color record can influence development in one or both of the other color records. These types of interactions are well known in the photographic art and are the result of both undesired chemical interactions during development and deliberate chemical and optical interactions designed to influence the overall color reproduction of the film. The inverse of this matrix $(MAT_{ii})^{-1}$, in combination with the density representative digital signal $(RT_i, G_{Ti}, B_{Ti})$ of the high temperature, rapidly processed film according to this invention, can be used to calculate a channel independent density representative digital signal $(R_{ci}, G_{ci}, B_{ci})$ representative of those densities that would have been obtained for the particular exposure if there were no interactions between layers):

$$\begin{bmatrix} R_{Ci} \\ G_{Ci} \\ B_{Ci} \end{bmatrix} = MAT^{ii} - 1 \begin{bmatrix} R_{Ti} \\ G_{Ti} \\ B_{Ti} \end{bmatrix}.$$

The red, green and blue channel independent density representative digital signals $(R_{ci}, G_{ci}, B_{ci})$ are then converted to log(exposure or E) representative digital signals $(R_{LE}, G_{LE}, B_{LE})$ by the use of three one dimensional look-up tables. The recorded image is then in a form that is independent of the chemical processing.

The log(exposure) representative signals can now be processed in a variety of ways. They can be processed so as to achieve the color density representative digital signals $(R_{oi}, G_{oi}, B_{oi})$ which would have been achieved by a well manufactured, correctly stored and processed film of the same photographic film type that has been given identical exposures and processed in a standard temperature, standard time process. Alternatively, those signals can be processed to achieve the density representative digital signals that would have been obtained for an alternative photographic film type that has been given the same exposures and processed through a standard temperature and standard time process. The methods for these corrections include, but are not limited to, mathematical constants, linear and non-linear mathematical relationships, and look-up tables (LUT's).

It is important to remember that while the images are in the digital form the image processing is not limited to the color and tone scale corrections described above. While the image is in this form, additional image manipulation may be used including, but not limited to, standard scene balance algorithms (to determine printing corrections based on the densities of one or more areas within the negative), sharpening via convolution or unsharp masking, red-eye reduction and grain-suppression. Moreover, the image may be artistically manipulated, zoomed, cropped, combined with additional images, or other manipulations known in the art. Once the image has been corrected and any additional image processing and manipulation has occurred, the image may be written to a variety of devices including, but not limited to, silver-halide film or paper writers, thermal printers, electro-photographic printers, ink-jet printers, display monitors, CD disks and other types of storage and display devices.

A designed factorial of processing conditions and compositions that were within the regions specified by Cole and Bohan (U.S. Pat. No. 5,804,356) was performed. We found regions that gave good signal, along with reasonable D-min, reasonable D-max below 3.15 and toe speeds that were matched closely together. We also calculated a Chrominance Area (described below) of Kodak Max 800 film processed under the above designed factorial conditions. Typically, one would optimize the system based on the aim densitometric results. Even though there is no densitometric aim for rapidly processed films one can still provide chemical compositions and processing conditions that maximize film performance. First, we optimized on gamma normalized granularity signal vs. the gamma normalized granularity of a check film in the standard 195 second development time process of C-41 to insure that from a signal to noise standpoint we achieved the same photographic speed recording capability. We then optimized by minimizing the amplification required to restore colors measured in the rapid process to the color achieved in the C-41 process.

Our objective was to find developer chemical compositions and processing conditions that exhibited good values in the toe region of the characteristic curve, had low D-min, and had D-max values that were below about 3.0 density. We further limited chemical composition and processing conditions subject to minimum gamma constraints. We then optimized based on minimizing the amplification required to restore colors measured in the rapid process to the color achieved in the C-41 process by maximizing the area enclosed by chrominance values measured from scanned red, green, blue, cyan, magenta, and yellow target color patches.

Another objective was to find developer chemical compositions and processing conditions for rapid film processing (development in less than 90 seconds) that produced superior color negative images for digital scanning. For simplicity and case of analysis, we optimized the developer composition to three photographic parameters. More parameters can be included to further refine the results, if desired. These three parameters and their respective boundary conditions had the following requirements: (1) require the maximum blue record density to be below a threshold value, such as a density of 3.5, (2) require the red record contrast as measured by the best fit slope to be greater than 0.15, and after defining the development area with the first two parameters, further minimize the area by (3) employing developer compositions that are within 70% of the maximum possible chrominance area values. The first requirement acknowledges, that at an optical density of 3.5, many digital scanners will have high noise levels due to the small fraction of light transmitted through the sample. We further limited chemical composition and processing conditions subject to minimum gamma constraints. In rapid development, the red color record of conventional color negative films would typically be under developed when compared to standard processing such as Kodak C41 processing. We then optimized based on minimizing the amplification required to restore colors measured in the rapid process to the color achieved in the C-41 process by maximizing the area enclosed by chrominance values measured from scanned film images of red, green, blue, cyan, magenta, and yellow target color patches.

We developed a designed factorial of processing conditions and compositions that were within the regions specified by Cole and Bohan (U.S. Pat. No. 5,804,356). We found regions that complied with the boundary conditions that the maximum blue density be below 3.5 and the red color (best fit slope) contrast be above 0.15. We also calculated a chrominance area (described below) of Kodak Max 800 film processed under the above designed factorial conditions. Typically, one would optimize the system based on the aim densitometric results. Even though there is no densitometric aim for rapidly processed films, one can still provide chemical compositions and processing conditions that maximize film performance. First, we optimized on gamma normalized granularity signal vs. the gamma normalized granularity of a check film in the standard 195 second development time process of C-41 to insure that from a signal to noise standpoint we achieved the same photographic speed recording capability. We then optimized by minimizing the amplification required to restore colors measured in the rapid process to the color achieved in the C-41 process.

Chrominance Area analysis

The images of the MacBeth Color Checker Chart were scanned with a Kodak Professional RFS film scanner. The scanner was calibrated and focused for each scan and images from day to day gave the same results The film matrix that was used for the default in the scanner was film 5190, the original 800 MAX film.

ADOBE PHOTOSHOP 5.0 mathematical model was used to obtain the RBG and CIE Lab values of the gray scale and the cyan, magenta, yellow, red, green and blue patches of the color chart image on each film for the 2 stop over exposure frame. While the CIE Lab values in the context of the above described experiment and method may not correspond to true CIE Lab data, the RGB to CIE Lab transformation provided by PHOTOSHOP served to map the scanner RGB values to a chrominance area that could be used to maximize the chrominance area which is a useful measure of minimizing the subsequent digital amplification required to recover a full color image. In other words, the larger the chrominance area, the less amplification required. Hereafter it is understood that a* and b* refer to the aforementioned values produced from the described scanner and PHOTOSHOP processing and they do NOT refer to true calorimetric data. The a* and b* values for each patch were tabulated in EXCEL. A simple estimate of the attained chrominance area for the Kodak MAX 800 film with any developer formula could be made by calculating the a* x b* area of the boundary of a figure defined by the a* and b* values of red, green, blue, cyan, magenta, and yellow. For simplicity, this boundary was made by connecting adjacent color patch values to form a six sided figure. The figure was divided into four triangles and the area was calculated via summing the areas of the four triangles. FIG. 1 shows the triangles.

Film: The films used in the following examples are 1 inch by 12 inch strips Kodak Max 800. The photographic speed is ISO 800.

Film Exposure: The films for the determination of photographic parameters were exposed on a Kodak 1B sensitometer through a 21 step tablet that incremented the step density in units of 0.2 density from a density of 0 to a density of 4.0. The light source was a simulated daylight exposure with a color temperature of 5500 K.

The films used in the chrominance maximizing area determination were camera exposed images of a MacBeth Color Checker Chart that was photographed under constant lighting conditions.

Film processing: All film processing was done in deep tanks on special racks that held the films vertical in the tank. The agitation was via bursts of nitrogen bubbles for two seconds, every six seconds, in the development tank. All other tanks had vigorous and continuous air bubble agitation, except for the final rinse, which had no agitation.

Photographic parameter data: The densitometric data were collected with an automated, 49 micron aperture granularity instrument and the parameters were calculated via algorithms well know in the trade. Data tables were constructed by importing the data into EXCEL (Microsoft Corporation) spreadsheets and JMP (SAS Institute) spreadsheets.

Obtaining digital images of MacBeth Color Chart: The films for the maximizing chrominance area determination were camera exposed images of a MacBeth Color Checker Chart that was photographed under constant lighting conditions with Kodak 800 MAX film. The images of the MacBeth Color Checker Chart were scanned with a Kodak Professional RFS (MODEL 3570) film scanner. The scanner was calibrated and focused for each scan and images from day to day gave the same results. The film matrix that was used for the default in the scanner was film 5190, the original 800 MAX film.

The following examples are presented to illustrate, but not limit, the practice of this invention.

EXAMPLES

Example 1

Example 1 describes a designed factorial model that is within the developer composition and processing conditions described by Cole and Bohan.

The film processing cycles are in the Table 1 below. The cross over time between all tanks is 10 seconds for the C-41 development and 5 seconds for the Rapid development. For example, in the C-41 development, the film would be in listed time of 195 seconds is 185 seconds in the tank, followed by 10 seconds out of the tank solution, which includes drain time and positioning time, prior to dropping the film into the bleach tank precisely 195 seconds after the film was dropped into the development tank. The rapid process is similar, with 25 seconds in the development tank, followed by a 5 second drain and position time prior to dropping into the bleach tank precisely at 30 seconds after the initial drop into the development tank.

Processing of film with the MacBeth Color Checker Chart images was done in the same time as the respective 21 step tablet exposure for that film for each of the 33 developers in the factorial.

TABLE 1

| process step | process times for C-41 development | Process times for Rapid Development |
|---|---|---|
| Development | 195 sec. | 30 sec. |
| bleach | 45 sec. | 45 sec. |
| water wash | 30 sec. | 30 sec. |
| fixer | 90 sec. | 90 sec. |
| wash | 30 sec. | 30 sec. |
| photoflo rinse | 60 sec. | 60 sec. |

The base composition of the developers for the study are shown in Table 2 below. The factorial design was a fractionated, two level design of five factors and it included axial points. The factors were temperature in degrees C, pH, and the following three chemicals reported in grams per liter of processing solution: sodium bromide, potassium sulfite and 4-(N-Ethyl-N-2_-hydroxyethyl)-2-methylphenylenediamine sulfate. The levels of the factors in the design are reported in Table 3 below. All concentrations for chemicals are reported in grams per liter of final solution. The pH of the one liter solution was adjusted to the aim pH with potassium hydroxide or sulfuric acid at 24° C.

TABLE 2

| chemical name | Rapid Formula A moles/liter |
|---|---|
| hydroxylamine sulfate | |
| diethylenetriamine pentaacetic acid sodium salt | 0.0051663 |
| potassium iodide | 1.205E-05 |
| poly(vinyl pyrrolidone) in gms/liter | 3.000 |
| sodium bromide | Table 3 |
| potassium carbonate | 0.2894147 |
| 4-(N-Ethyl-N-2-hydroxyethyl)-2-methylphenylenediamine Sulfate | Table 3 |
| potassium sulfite sodium sulfite | Table 3 |
| pH adjusted to a value of | Table 3 |
| Processing temperature in degrees C. | Table 3 |

TABLE 3

| de-veloper | design | temp C. | SO3 molarity | KBr molarity | CD4 molarity | pH value | time sec. |
|---|---|---|---|---|---|---|---|
| B-1 | + + − − + | 58 | 0.0837 | 0.0126 | 0.0445 | 10.5 | 30 |
| B-2 | + − − − − | 58 | 0.0331 | 0.0126 | 0.0445 | 10.1 | 30 |
| B-3 | + − − + + | 58 | 0.0331 | 0.0126 | 0.0581 | 10.5 | 30 |
| B-4 | 00000T | 55 | 0.0584 | 0.0210 | 0.0513 | 10.3 | 40 |
| B-5 | + + + − − | 58 | 0.0837 | 0.0294 | 0.0445 | 10.1 | 30 |
| B-6 | + + + + + | 58 | 0.0837 | 0.0294 | 0.0581 | 10.5 | 30 |
| B-7 | + − + − + | 58 | 0.0331 | 0.0294 | 0.0445 | 10.5 | 30 |
| B-8 | + + − + − | 58 | 0.0837 | 0.0126 | 0.0581 | 10.1 | 30 |
| B-9 | + − + + − | 58 | 0.0331 | 0.0294 | 0.0581 | 10.1 | 30 |
| B-10 | − − − + − | 52 | 0.0331 | 0.0126 | 0.0581 | 10.1 | 30 |
| B-11 | − + − − − | 52 | 0.0837 | 0.0126 | 0.0445 | 10.1 | 30 |
| B-12 | − − + − − | 52 | 0.0331 | 0.0294 | 0.0445 | 10.1 | 30 |
| B-13 | − + + + − | 52 | 0.0837 | 0.0294 | 0.0581 | 10.1 | 30 |
| B-14 | − − + + + | 52 | 0.0331 | 0.0294 | 0.0581 | 10.5 | 30 |
| B-15 | − + − + + | 52 | 0.0837 | 0.0126 | 0.0581 | 10.5 | 30 |
| B-16 | 00000T | 55 | 0.0584 | 0.0210 | 0.0513 | 10.3 | 20 |
| B-17 | − − − − + | 52 | 0.0331 | 0.0126 | 0.0445 | 10.5 | 30 |
| B-18 | − + + − + | 52 | 0.0837 | 0.0294 | 0.0445 | 10.5 | 30 |
| B-19 | L0000 | 51 | 0.0584 | 0.0210 | 0.0513 | 10.3 | 30 |
| B-20 | 000H0 | 55 | 0.0584 | 0.0210 | 0.0616 | 10.3 | 30 |
| B-21 | 0H000 | 55 | 0.1027 | 0.0210 | 0.0513 | 10.3 | 30 |
| B-22 | 00000 | 55 | 0.0584 | 0.0210 | 0.0513 | 10.3 | 30 |
| B-23 | 0000L | 55 | 0.0584 | 0.0210 | 0.0513 | 10.3 | 30 |
| B-24 | 000L0 | 55 | 0.0584 | 0.0210 | 0.0410 | 10.3 | 30 |
| B-25 | 00000 | 55 | 0.0584 | 0.0210 | 0.0513 | 10.3 | 30 |
| B-26 | 00L00 | 55 | 0.0584 | 0.0084 | 0.0513 | 10.3 | 30 |
| B-27 | 00000 | 55 | 0.0584 | 0.0210 | 0.0513 | 10.3 | 30 |
| B-28 | 0L000 | 55 | 0.0141 | 0.0210 | 0.0513 | 10.3 | 30 |
| B-29 | 00H00 | 55 | 0.0584 | 0.0336 | 0.0513 | 10.3 | 30 |
| B-30 | 0000H | 55 | 0.0584 | 0.0210 | 0.0513 | 10.6 | 30 |
| B-31 | H0000 | 59 | 0.0584 | 0.0210 | 0.0513 | 10.3 | 30 |

It can be observed that all of the developer formulations in Table 3 are within the boundary regions described in the patent of Cole and Bohan (U.S. Pat. No. 5,804,356). Their regions are listed in Table 4.

TABLE 4

| | | | Relisted in terms of gm/l | |
|---|---|---|---|---|
| | low molarity | high molarity | low Gm/liter | high gm/liter |
| pH | 9 | 12 | 9 | 12 |
| temp (C.) | 40 | 65 | 40 | 65 |
| time (sec) | <90 | 90 | | <90 |
| HAS | 0.001 | >0.001 | 0.16414 | |
| I | 0.0000005 | >0.0000005 | >0.000083 | |
| CD-4. | 0.01 | 0.15 | 2.925 | 43.875 |

TABLE 4-continued

| | | | Relisted in terms of gm/l | |
|---|---|---|---|---|
| | low molarity | high molarity | low Gm/liter | high gm/liter |
| NaBr | 0 | 0.2 | 0 | 20.58 |
| KBr | 0 | 0.2 | 0 | 23.802 |
| sulfite | No Claim | examples have <3.5 gm/liter | | |

Cole & Bohan limits in U.S. Pat. No. 5,804,356 claims

The composition of the C-41 RA bleach is in Table 5 below. All component concentrations are reported in grams per liter of final solution. The pH of the one liter solution was adjusted to the aim pH with ammonium hydroxide or sulfuric acid at 24° C.

TABLE 5

| | |
|---|---|
| Propylene diamine tetraacetic acid | 113.6 |
| Kodak anti-cal 3 | 0.953 |
| glacial acetic acid | 51.49 |
| ammonium bromide | 94.67 |
| ferric nitrate nonahydrate | 136.93 |
| pH adjusted to a value of | 4.5 |

The composition of the C-41 RA fixer is in Table 6 below. All component concentrations are reported in grams per liter of final solution. The pH of the one liter solution was adjusted to the aim pH with ammonium hydroxide or sulfuric acid at 24° C.

TABLE 6

| | |
|---|---|
| Ammonium thiosulfate | 112.85 |
| Ammonium sulfite | 7.99 |
| sodium sulfite | 14.00 |
| Ammonium thiocyanate | 90.00 |
| EDTA, dihyrated sodium salt | 1.20 |
| galcial acetic acid | 0.77 |
| pH adjusted to a value to | 6.20 |

Examples of developers within the range boundaries of Cole and Bohan (U.S. Pat. No. 5,804,356) that produce unacceptable photographic images for digital scanning based on a maximum blue record density signal are shown in Table 7 below. By inspection, the developers listed below would not be suitable as developers for Kodak Max 800 at a 30 sec processing time, and especially B-4 at a 40 second processing time. We therefore demonstrate that not all conditions within the boundary ranges of Cole and Bohan (U.S. Pat. No. 5,804,356) produce results that are acceptable for a film image that is readily digitally scannable to produce a digital imaging file. We generously put the cut off of these data at 0.25 density units above the C-41 standard processed film sample. In addition, the D-min response for the listed developers is also significantly above the D-min of the check film.

TABLE 7

| developer | time sec. | Blue D-max density | Blue D-min Density |
|---|---|---|---|
| B-4 | 40 | 3.48 | 1.411 |
| B-3 | 30 | 3.47 | 1.782 |
| B-1 | 30 | 3.38 | 1.596 |
| B-31 | 30 | 3.36 | 1.436 |

TABLE 7-continued

| developer | time sec. | Blue D-max density | Blue D-min Density |
|---|---|---|---|
| B-6 | 30 | 3.34 | 1.321 |
| B-7 | 30 | 3.32 | 1.323 |
| B-8 | 30 | 3.32 | 1.490 |
| B-2 | 30 | 3.30 | 1.466 |
| B-26 | 30 | 3.20 | 1.410 |
| B-9 | 30 | 3.17 | 1.250 |
| B-28 | 30 | 3.15 | 1.223 |
| B-20 | 30 | 3.15 | 1.222 |
| C-41 Check | 195 | 2.90 | 1.093 |

Example 2

Examples of developers within the range boundaries of Cole and Bohan (U.S. Pat. No. 5,804,356) that produce unacceptable photographic images for digital scanning based on the red record best fit contrast signal are shown in Table 8 below. We also develop the concept of chrominance area.

Defining and Calculating Chrominance Area from RGB and CIE Lab Values ADOBE PHOTOSHOP 5.0 was used to obtain the RBG and CIE Lab values of the gray scale and the cyan, magenta, yellow, red, green and blue patches of the color chart image on each film for the 2 stop over exposure frame. While the CIE Lab values in the context of the above described experiment and method may not correspond to true CIE Lab data, the RGB to CIE Lab transformation provided by PHOTOSHOP served to map the scanner RGB values to a chrominance area that could be used to maximize the chrominance area which is a useful measure of minimizing the subsequent digital amplification required to recover a full color image. In other words, the larger the chrominance area, the less amplification required. Hereafter it is understood that a* and b* refer to the aforementioned values produced from the described scanner and PHOTOSHOP processing and they do NOT refer to true calorimetric data. The a* and b* values for each patch were tabulated in EXCEL. A simple estimate of the attained chrominance area for the Kodak MAX 800 film with each of the developer formulas in Table 3a was made by calculating the a* x b* area of the boundary of a figure defined by the a* and b* values of red, green, blue, cyan, magenta, and yellow. For simplicity, this boundary was made by connecting adjacent color patch values to form a six-sided figure. The figure was divided into four triangles and the area was calculated via summing the areas of the four triangles. FIG. 1 shows the triangles.

TABLE 8

| developer | temp C. | time sec. | Red Best Fit Slope | Green Best Fit Slope | Chrominance Space Area (a* × b*) |
|---|---|---|---|---|---|
| B-16 | 55 | 20 | 0.101 | 0.278 | 7 |
| B-12 | 52 | 30 | 0.171 | 0.354 | 41 |
| B-13 | 52 | 30 | 0.185 | 0.383 | 40 |
| B-18 | 52 | 30 | 0.186 | 0.369 | 35 |
| B-19 | 51 | 30 | 0.186 | 0.386 | 85 |
| B-11 | 52 | 30 | 0.191 | 0.399 | 316 |
| B-14 | 52 | 30 | 0.201 | 0.433 | 125 |
| B-10 | 52 | 30 | 0.210 | 0.467 | 432 |
| B-15 | 52 | 30 | 0.210 | 0.456 | 361 |
| C-41 check | 37.8 | 195 | 0.506 | 0.583 | 3337 |

The processing cycle is the same as listed in Table 1 of Example 1. The developer compositions are the same as listed in Tables 2 and 3 of Example 1.

The same bleach and fix compositions were used as listed in Tables 5 and 6 of Example 1.

By inspection, the developers listed below would not be suitable as developers for Kodak Max 800 at a 30 sec processing time. We therefore demonstrate that not all conditions within the boundary ranges of Cole and Bohan (U.S. Pat. No. 5,804,356) produce results that are acceptable for a film image that is readily digitally scannable to produce a digital imaging file. The 20 second processing with the center point chemical composition at 55° C. has very low red and green contrast. The low value of 7 for the chrominance area reinforces the point that going much lower than 30 seconds for processing with the base formula described here will not produce acceptable images. Inspection of Table 8 also reveals many other developers that produce results severely deficient in red contrast as measured by best fit slope.

The data in Tables 7 and 8 are offered as comparison developers that do not produce suitable scannable images in a rapid, 30 second development process. Not only does the Kodak Max 800 film produce low red best fit slope values for there points, but the chrominance area number is also low.

Example 3

In Example 3, we identify by inspection discrete model data points that satisfy the boundary conditions of maximum blue record density below 3.15 and also show have red contrasts as described by the best fit slope to be greater than 0.210. These attributes also correlate well with the value for the chrominance space are as defined in Example 2 above.

The processing cycle is the same as listed in Table 1 of Example 1. The developer compositions are the same as listed in Tables 2 and 3 of Example 1. The same bleach and fix compositions were used as listed in Tables 5 and 6 of Example 1.

In Table 9, we list several of the responses from the developers of the factorial design that demonstrate that developer composition is unacceptable for processing film negatives for scanning. We also highlight the inventive developer formulations that can produce film negatives that are suitable for digital scanning. The films also have chrominance areas that are 500 or greater. Although the inventive developer formulations have maximum blue record densities similar to the C41 check, the inventive rapid developer formulations have low red contrast as measured by the red best fit slope.

TABLE 9

| developer | Maximum Blue Density | Red Best Fit Slope | Chrominance Space Area = (a*xb*) | status |
|---|---|---|---|---|
| B-31 | 3.36 | 0.328 | 2132 | comparison |
| B-14 | 2.83 | 0.201 | 125 | comparison |
| B-1 | 3.38 | 0.322 | 1653 | comparison |
| B-10 | 2.88 | 0.210 | 432 | comparison |
| B-12 | 2.46 | 0.171 | 41 | comparison |
| B-22 | 3.00 | 0.252 | 844 | comparison |
| B-27 | 3.01 | 0.251 | 542 | invention |
| B-30 | 3.11 | 0.257 | 883 | invention |
| B-21 | 2.97 | 0.241 | 461 | invention |
| B-24 | 2.97 | 0.255 | 1014 | invention |
| C41 check | 2.93 | 0.515 | 3337 | check |

Example 4

The film that was processed in the C-41 check process had the largest chrominance area. We used the above described chrominance area parameter to define a model surface in the factorial design listed in Table 3a. From that model, one could predict factor level changes that would make the model developer more like the check developer. The only factor that would move to a boundary during the optimization was the temperature, and it always moved to the highest boundary condition. We limited the boundary level for the temperature to several values and ran the prediction option. The results are in Table 10.

The method that we employed to generate the statistical model is generic to any set of data, especially developer processing models that differ in constituents and processing parameters such as, time of development, or other parameters. The only constraint is that additional data must be collected and a new model produced. The statistical model was determined by analysis of the data in the statistical computer program package JMP version 3.2.6 (SAS Institute Inc., Cary, N.C., USA) All 29 (left out the time variations of B-4 and B-16) factor levels (values of temperature, pH, and the concentrations of sulfite, bromide and developing agent) for each processing run in Table 3a were tabulated in an EXCEL spreadsheet, along with their respective experimental chrominance area response. Within the Microsoft Windows 2000 environment, the EXCEL spreadsheet was uploaded into JMP spreadsheet. Multiple types of statistical analysis can now be performed on the data in the JMP spreadsheet using the JMP program. In addition, the JMP program can export the data as SAS transport files that are amenable to analysis with sophisticated programs on mainframe computers that run additional SAS Institute Inc. software, in particular, programs that are written in the SAS programming language.

Our major method of analyzing the JMP spreadsheet data within the JMP program was the following. The first step was to graph the data to make sure that the data transferred correctly to JMP and that there were no unexplained outliers in the data. The second point was to generate a mathematical model for the data via the following set of commands in JMP: Analyze, then Fit Model. We defined the effect factors to be the temperature, pH, and concentrations of sulfite, bromide, and developing agent. We picked the model type to be the response surface model and the response factors were maximum blue record density, Blue record D-min, the red contrast as measured by best fit slope, and the chrominance area. After the model was run, the parameter field contained a listing of all of the coefficients and the constant for the quadratic fit of all of the first and second order model terms, including the cross terms. A graphical prediction profile was also generated and initialized at the center point values of the effect factor levels. One could now interactively drag the data lines of the graph for the various effect factors to analyze how the response factor values change. One could optimize simple systems like this one on the JMP graphical interface by iteratively observing responses vs. effect changes, and moving to an optimum region of the design area.

One is not limited to the effect factors and response factors mentioned above. In particular, an analogous response factor, which we will call the delta RGB, correlates well with the chrominance area. Delta RGB is defined in the following way. As we mentioned above, we have tabulated all of the RGB data for each red, green blue, cyan, magenta, and yellow image patch on the film for each processing condition of the factorial model and a C41 standard processing check. For a given factorial processing condition, we can determine the Euclidian distance between the check RGB value and the factorial processing condition RGB value for each of the six color patches. Sunming the six distances together gives an indication of how close the factorial processing condition is to the check processing condition. The lower the summed value, the more optimum is the factorial processing condition. One can do this analysis in JMP in exactly the same way as the above chrominance area method, except the optimum processing condition and developer composition should produce a minimum value for the summed distances.

One is not limited to doing the statistical optimization process with the graphical interface of the JMP software. One can also use software from other vendors, such as Minitab, and also mainframe computer software, such as the SAS programming language by SAS Institute Inc. An elegant option is to write a program in SAS programming language code and have the software include an algorithm to find the optimum vs. the aim values. Such a subroutine is the Quasi-Newton Optimization. There is a description of the subroutine in the SAS manual "SAS/IML Software Changes and Enhancements—through Release 6.11", manual number 555492, chapter 4 from SAS Institute Inc. We have accomplished such optimizations of the above data with custom SAS software programs owned by the Eastman Kodak Company.

For a 30 second development process with the factorial design from Table 3, we find that we can use the model from the JMP program and manipulate the factor levels on the interactive graphical interface to obtain regions that are maximized for the chrominance area metric. In all cases, the model predicts the upper bound for temperature. Temperature is the major driving force to greater developability of all three color records. However, the other four factors are found to have values that are not at the boundaries, but comfortably within the design space range.

In Table 10, we list developers C, D, E, F, and G, that were found to be optima based on the maximization of the chrominance area. The film that was processed in the C-41 check process had the largest chrominance area. From that model, one could predict factor level changes that would make the model developer more like the check developer. We also calculated the predicted a* x b* area for the effective chrominance area.

TABLE 10

Predictions based on Maximization of Chrominance Space Area

| | Dev. G prediction | Dev. F prediction | Dev. E prediction | Dev. D prediction | Dev. C prediction |
|---|---|---|---|---|---|
| temperature in degrees C. | 59.0 | 59.0 | 56.8 | 54.6 | 52.4 |
| sulfite molarity | 0.0732 | 0.0585 | 0.0557 | 0.0486 | 0.0252 |

TABLE 10-continued

| Predictions based on Maximization of Chrominance Space Area | | | | | |
|---|---|---|---|---|---|
| | Dev. G prediction | Dev. F prediction | Dev. E prediction | Dev. D prediction | Dev. C prediction |
| bromide molarity | 0.0222 | 0.0307 | 0.0244 | 0.0219 | 0.0183 |
| developing agent molarity | 0.0557 | 0.0433 | 0.0616 | 0.0547 | 0.0616 |
| pH | 10.36 | 10.53 | 10.38 | 10.42 | 10.45 |
| color gamut predicted | 2932.749 | 2822.576 | 2991.6081 | 2700.127 | 2643.77094 |

A more general model of the factorial design in Table 3 could also include time as a factor. However, in this example, we set the time development time at 30 seconds. From the JMP parameter Tables, we obtain the coefficients and the constant for the quadratic fit of the response, in this case the chrominance area, to the five variables. Explicitly, for the data in this experiment, a unique equation be written for every response factor.

For the chrominance area, the equation, with concentrations expressed in moles/liter is the following:

$$CS=-288240-1897.3\times T-85351\times S-360960\times B-119840\times D+66507\times P-11.705\times T\times T-528.31\times S\times T-114130\times S\times S-59.505\times B\times T-$$

$$22917\times B\times S-222700\times B\times B+1114.6\times D\times T+239620\times D\times S\ 993760\times D\times B1259500\times D\times D+78.542\times P\times T\ 10912\times P\times S+29381\ \times P\times B-9684.1\times P\times D-3454.2\times P\times P$$

The above equations are in terms of moles/liter for the component materials and the variables would then have the units as follows: T=temperature in degrees C., S=sulfite in moles/liter, B=bromide in moles/liter, D=developing agent (s) in moles/liter, and P=pH in pH units at 24° C.

It should be noted that the equations can be cast recast in any convenient set of units.

TABLE 11

| developer | Maximum Blue density | Red Best Fit Slope | Status |
|---|---|---|---|
| Devel. C | 2.98 | 0.218 | Invention |
| Devel. D | 3.09 | 0.261 | Invention |
| Devel. E | 3.27 | 0.312 | Comparison |
| Devel. F | 3.27 | 0.309 | Comparison |
| Devel. G | 3.38 | 0.336 | Comparison |

In Table 11, we report the photographic results of the processing with the predicted developer formulation compositions, formula C though formula G. Only formula C and D have Blue D-max values that are under the acceptable upper bound limit of 3.10. These two developers also have reasonable red slope contrast.

The data in table 11 is experimental data. It is from film that was processed at the predicted developer compositions and processing conditions listed in Table 10. We observe that developers C and D produce maximum blue densities that are below 3.1. Developers E, F, and G have higher values, and would not be appropriate for many scanners. All of the developers have a red best fit slope that is above 0.215. The red signal is reasonable for digital enhancement to provide pictures files of high quality.

We determined the experimental chrominance area for only one of the developers. The value was 1500. This is unexpectedly low. However, models have greater difficulty predicting values at the boundary levels, and in the model, the temperature of 59° C. is an axial level. The model is not well defined there. A model with higher temperature ranges than the levels in the model in Table 3 would be needed for better predictive capabilities at 59° C.

Example 5

Method of determining any developer compositions and processing conditions that have a maximum blue record density below 3.15, and therefore suitable for processing color negative film images for digital scanning.

The factorial design in Table 3 can be used to generate a mathematical model of how a response variable, such as maximum blue record density would vary with the levels of the five factors. The methodology is exactly the same as for example 4. The unique equation derived from calculating the parameter table in JMP is shown below. Using this equation, one can rapidly determine what areas of the design space would provide developer compositions and processing conditions that would yield maximum blue record densities below 3.15.

Bdmax, with concentrations expressed in moles/liter gives the following equation:

$$\text{Bdmax}=-78.658+0.25006\times T+4.7743\times S-174.26\times B+102.25\times D+13.4\times P-0.002084\times T\times T+0.012755\times S\times T+11.893\times S\times S+0.6434\times B\times T-$$

$$4.8478\times B\times S+29.136\times B\times B-0.94252\times D\times T+59.363\times D\times S+181.03\times D\times B+198.27\times D\times D+0.010364\times P\times T-1.1171\times P\times S+11.362\times P\times B-6.7378\times P\times D-0.64857\times P\times P$$

The above equations are in terms of moles/liter for the component materials and the variables would then have the units as follows: T=temperature in degrees C., S=sulfite in moles/liter, B=bromide in moles/liter, D=developing agent (s) in moles/liter, and P=pH in pH units at 24° C.

It should be noted that the equations can be cast recast in any convenient set of units. As an illustrative example, the Bdmax can be recast in terms of grams per liter of the materials, using the appropriate molecular weights of the materials. The equations for the determination of blue record max density using gms/liter for the units of the materials is the following:

$$\text{Bdmax}=-78.658+0.25006\times T+0.030217\times S-1.4643\times B+0.34975\times D+13.4\times P-0.002084\times T\times T+0.0000807\times S\times T+0.0004764\times S\times S+$$

$$0.0054062\times B\times T-0.000258\times B\times S+0.0020571\times B\times B\ -0.003224\times D\times T+0.0012852\times D\times S+0.0052031\times D\times B+0.0023198\times D\times D+0.010365\times P\times T-0.00707\times P\times S+0.095469\times P\times B-0.023047\times P\times D-0.648572\times P\times P$$

Where, in the above equation, T=temperature in degrees C., S=potassium sulfite in grams/liter, B=potassium bromide in grams/liter, D=developing agent in grams/liter, and P=pH in pH units at 24° C.

Example 6

Method of determining any developer compositions and processing conditions that have a red best fit slope above 0.21, and therefore suitable for processing color negative film images for digital scanning.

The factorial design in Table 3 can be used to generate a mathematical model of how a response variable, such as maximum blue record density would vary with the levels of the five factors. The methodology is exactly the same as for example 4. The unique equation derived from calculating the parameter table in JMP is shown below. Using this equation, one can rapidly determine what areas of the design space would provide developer compositions and processing conditions that would yield a red best fit contrast of 0.215 or greater.

For the red record best fit slope, the equation, with concentrations expressed in moles/liter is the following:

$$Rbfs=-16.805-0.020274\times T+4.5693\times S-13.661\times B+8.3327\times D+3.2321\times P+0.0000678\times T\times T-0.023042\times S\times T+0.79677\times S\times S-0.014876\times$$

$$B\times T+7.9328\times B\times S-8.1877\times B\times B-0.073088\times D\times T+9.7435\times D\times S-1.0873\times D\times B68.368\times D\times D+0.0036458\times P\times T-0.41969\times P\times S+1.2645\times P\times B-1.0963\times P\times D-0.16167\times P\times P$$

The above equations are in terms of moles/liter for the component materials and the variables would then have the units as follows: T=temperature in degrees C., S=sulfite in moles/liter, B=bromide in moles/liter, D=developing agent (s) in moles/liter, and P=pH in pH units at 24° C.

Example 7

The above equations are illustrative of models for processing at 30 seconds. It must be emphasized that the model could also have included many other factors as the effect variables, including development time. We have run models with development time as a variable, and they models are predictive of changes to the development response variables, including the time factor.

A color negative film developer composition and processing condition that allows for optimum rapid processing of the film for subsequent digital scanning and digital image file manipulation. The rapid processing can be from a time of 20 seconds to 90 seconds in the developer solution. The temperature of the developer solution can be from 40° C. to 65 ° C.

A preferred embodiment of the invention is the generation of a film negative for digital scanning that was developed to the following photographic parameters and conditions:

The Blue record maximum density is less than or equal to an optical density of 3.5.

The Red record Best Fit Contrast is equal to or greater than 0.15.

The chrominance space area or similar metric is maximized.

The development processing is done for 20 seconds or longer.

The factor levels of temperature in degrees C., pH in pH units at 24 C., and the molarities of the bromide ion, sulfite ion, and color developer compound(s) that, when used in the below set of three defining functions, model the ranges of the photographic parameters above for Blue record D-max, Red record best fit contrast, and maximize the chrominance space area.

The function for the Blue record maximum density, Bdmax, is then:

Bdmax=f (T, S, B, D, P), where T in the temperature, S is the concentration of sulfite, B is the concentration of bromide, D is the concentration of developing agent(s), and P is the pH of the developer solution at 24 C.

The function for the Red record best fit slope (contrast) , Rbfs, is then:

Rbfs=f (T, S, B, D, P), where T in the temperature, S is the concentration of sulfite, B is the concentration of bromide, D is the concentration of developing agent(s), and P is the pH of the developer solution at 24 C.

CS==f (T, S, B, D, P), where T in the temperature, S is the concentration of sulfite, B is the concentration of bromide, D is the concentration of developing agent(s), and P is the pH of the developer solution at 24 C.

An example of equations optimized to a 25 second development step in the processing sequence that satisfy the above functions are as follows:

Bdmax, with concentrations expressed in moles/liter gives the following equation:

$$\text{Bdmax}=-78.658+0.25006\times T+4.7743\times S-174.26\times B+102.25\times D+13.4\times P-0.002084\times T\times T+0.012755\times S\times T+11.893\times S\times S+0.6434\times B\times T-$$

$$4.8478\times B\times S+29.136\times B\times B-0.94252\times D\times T+59.363\times D\times S+181.03\times D\times B+198.27\times D\times D+0.010364\times P\times T-1.1171\times P\times S+11.362\times P\times B-6.7378\times P\times D-0.64857\times P\times P$$

For the red record best fit slope, the equation, with concentrations expressed in moles/liter is the following:

$$Rbfs=-16.805-0.020274\times T+4.5693\times S-13.661\times B+8.3327\times D+3.2321\times P+0.0000678\times T\times T-0.023042\times S\times T+0.79677\times S\times S-0.014876\times B\times T+7.9328\times B\times S-8.1877\times B\times B-0.073088\times D\times T+9.7435\times D\times S-$$

$$1.0873\times D\times B68.368\times D\times D+0.0036458\times P\times T-0.41969\times P\times S+1.2645\times P\times B-1.0963\times P\times D-0.16167\times P\times P$$

For the chrominance space area, the equation, with concentrations expressed in moles/liter is the following:

$$CS=-288240-1897.3\times T-85351\times S-360960\times B-119840\times D+66507\times P-11.705\times T\times T-528.31\times S\times T-114130\times S\times S-59.505\times B\times T-$$

$$22917\times B\times S-222700\times B\times B+1114.6\times D\times T+239620\times D\times S993760\times D\times B\ 1259500\times D\times D+78.542\times P\times T10912\times P\times S+29381\ P\times B-9684.1\times P\times D-3454.2\times P\times P$$

The above equations are in terms of moles/liter for the component materials and the variables would then have the units as follows: T=temperature in degrees C., S=sulfite in moles/liter, B=bromide in moles/liter, D=developing agent (s) in moles/liter, and P=pH in pH units at 24° C.

It should be noted that the equations can be cast recast in any convenient set of units. For example, the Bdmax can be recast in terms of grams per liter of the materials, using the appropriate molecular weights of the materials. The equations for the determination of blue record max density using gms/liter for the units of the materials is the following:

$$\text{Bdmax}=-78.658+0.25006\times T+0.030217\times S-1.4643\times B+0.34975\times D+13.4\times P-0.002084\times T\times T+0.0000807\times S\times T+0.0004764\times S\times S+$$

$$\mathbf{0.0054062}\times B\times T-0.000258\times B\times S+0.0020571\times B\times B-0.003224\times D\times T+0.0012852\times D\times S+0.0052031\times D\times B+0.0023198\times D\times D+0.010365\times P\times T-0.00707\times P\times S+0.095469\times P\times B-0.023047\times P\times D-0.648572\times P\times P$$

Where, in the above equation, T=temperature in degrees C., S=sulfite in grams/liter, B=bromide in grams/liter, D=developing agent in grams/liter, and P=pH in pH units at 24° C.

The above functions for blue record maximum density, red record best fit contrast, and chrominance area, with their respective boundary conditions, are useful for any processing time from 20 to 90 seconds, and may include additional materials added to the developer such as anticalcs, pH buffers, ion buffers, antifoggants, preservatives, antioxidants, surfactants, lubricants, antistats, and the like.

Examples of the other components of the developer solutions could be the following:

The sulfite is greater than 0.05 molar.

The bromide is between 0.005 to 0.04 molar.

The developing agent is between 0.02 to 0.1 molar.

The pH is between 10 to 10.9.

The carbonate is between 0.14 and 0.42 molar

The hydroxyl ammine stabilizer is above 0.005 molar.

The anticalc compound is above 0.005 molar

The potassium iodide is zero to 0.00009 molar.

The poly(vinyl pyrrolidone) polymer, or similar polymer is between 1 to 9 gms/liter, added as an anti fogger.

The processing conditions can be the following:

The development time is between 20 and 90 seconds.

The development temperature is between 40 and 65 C.

Any amount of solution agitation from none to up to any amount that is not physically destructive to the film.

Another embodiment of the invention is the generation of a film negative for digital scanning that was developed to the following photographic parameters and conditions:

The Blue record maximum density is less than or equal to an optical density of 3.2.

The Red record Best Fit Contrast is equal to or greater than 0.18.

The chrominance area or similar metric is maximized.

The development processing is done for 20 seconds or longer.

The factor levels of temperature in degrees C., pH in pH units at 25 C., and the molarities of the bromide ion, sulfite ion, and color developer compound(s) that, when used in the defining functions of statement 1 and associated equations, model the ranges of the photographic parameters above for Blue record D-max, Red record best fit contrast, and maximize the chrominance area.

In another embodiment of the invention is the generation of a film negative for digital scanning that was developed to the following photographic parameters and conditions:

The Blue record maximum density is less than or equal to an optical density of 3.1.

The Red record Best Fit Contrast is equal to or greater than 0.2.

The chrominance area or similar metric is maximized.

The development processing is done for 20 seconds or longer.

The factor levels of temperature in degrees C., pH in pH units at 25 C., and the molarities of the bromide ion, sulfite ion, and color developer compound(s) that, when used in the defining functions of statement 1 and associated equations, model the ranges of the photographic parameters above for Blue record D-max, Red record best fit contrast, and maximize the chrominance space area.

What is claimed is:

1. A method for deriving a color negative film developer composition and processing conditions for developing a photographic film image which is optimized for subsequent digital scanning and digital image file manipulation, which allows for optimum rapid development processing of the film, comprising:

a) identifying at least one independent variable that has a first order effect on the density of at least one of the red, green, and blue dye images of said developed image, b) selecting a desired range of values for the independent variables identified, c) formulating an experimental design that includes desired independent variables over the desired range of values, d) performing said experiment to obtain statistically significant values for desired dependent variables, e) applying said values to a mathematical model capable of providing a formula for optimizing responses to said dependent variables, and f) using the formula to identify desired optimal developer composition and processing conditions resulting in an developed image in which the subsequent required digital correction is reduced.

2. The method of claim 1, wherein said rapid development processing comprises a time of from about 20 seconds to about 90 seconds in the developer solution.

3. The method of claim 1, wherein said independent variable comprises a temperature of the developer solution of from about 40° C. to about 65° C.

4. The method of claim 1, wherein said dependent variable comprises a Blue record maximum density less than or equal to an optical density of about 3.5.

5. The method of claim 1, wherein said dependent variable comprises a Red record Best Fit Contrast equal to or greater than about 0.15.

6. The method of claim 1, wherein said dependent variable comprises a chrominance area which is maximized.

7. The method of claim 1, wherein said independent variable comprises a sulfite concentration greater than about 0.05 molar.

8. The method of claim 1, wherein said independent variable comprises a bromide concentration of from about 0.005 to about 0.04 molar.

9. The method of claim 1, wherein said independent variable comprises a developing agent concentration of from about 0.02 to 0.1 about molar.

10. The method of claim 1, wherein said independent variable comprises a pH of the developer solution of from about 10 to about 11.5.

11. The method of claim 1, wherein said developer solution further comprises an anticalc, a pH buffer, an ion buffer, an antifoggant, a preservative, an antioxidant, a surfactant, a lubricant, or an antistat.

12. The method of claim 1, wherein said developer solution further comprises a carbonate concentration of from about 0.14 to about 0.42 molar.

13. The method of claim 1, wherein said developer solution further comprises a hydroxyl ammine stabilizer concentration above about 0.005 molar.

14. The method of claim 1, wherein said developer solution further comprises an anticalc compound concentration above about 0.005 molar.

15. The method of claim 1, wherein said developer solution further comprises a potassium iodide concentration of from zero to about 0.00009 molar.

16. The method of claim 1, wherein said developer solution further comprises a poly(vinyl pyrrolidone) polymer at a concentration of from about 1 to about 9 gms/liter.

17. The method of claim 1, wherein said independent variables comprise the temperature, pH, and the molarities of the bromide ion, sulfite ion, and color developer compound(s) of said developer solution; said dependent variables comprise ranges of the photographic parameters for the Blue record maximum density, Red record best fit contrast, and the chrominance area; and the Blue record maximum density=f (T, S, B, D, P), where T is the temperature in degrees C., S is the concentration of sulfite, B is the concentration of bromide, D is the concentration of developing agent(s), and P is the pH of the developer solution at 24° C., Red record best fit slope=f (T, S, B, D, P), where T in the temperature in degrees C., S is the concentration of sulfite, B is the concentration of bromide, D is the concentration of developing agent(s), and P is the pH of the developer solution at 24° C., and Chrominance area=f (T, S, B, D, P), where T in the temperature in degrees C., S is the concentration of sulfite, B is the concentration of bromide, D is the concentration of developing agent(s), and P is the pH of the developer solution at 24° C.

18. The method of claim 1, wherein said processing conditions comprise a 25 second developer solution development time and said optimization formulas, wherein T=temperature in degrees C., S=sulfite in moles/liter, B=bromide in moles/liter, D=developing agent(s) in moles/liter, and P=pH in pH units at 24° C., comprise:

a Blue Record Maximum Density, according to the following equation:

$$Bd\max=-78.658+0.25006\times T+4.7743\times S-174.26\times B+102.25\times D+13.4\times P-0.002084\times T\times T+0.012755\times S\times T+11.893\times S\times S+0.6434\times B\times T-$$

$$4.8478\times B\times S+29.136\times B\times B-0.94252\times D\times T+59.363\times D\times S+181.03\times D\times B+198.27\times D\times D+0.010364\times P\times T-1.1171\times P\times S+11.362\times P\times B-6.7378\times P\times D-0.64857\times P\times P;$$

a Red Record Best Fit Slope, according to the following equation:

$$Rbfs=-16.805-0.020274\times T+4.5693\times S-13.661\times B+8.3327\times D+3.2321\times P+0.0000678\times T\times T-0.023042\times S\times T+0.79677\times S\times S-0.014876\times B\times$$

$$T+7.9328\times B\times S-8.1877\times B\times B-0.073088\times D\times T+9.7435\times D\times S-1.0873\times D\times B68.368\times D\times D+0.0036458\times P\times T-0.41969\times P\times S+1.2645\times P\times B-1.0963\times P\times D-0.16167\times P\times P;$$

and a Chrominance Area, according to the following equation:

$$CS=-288240-1897.3\times T-85351\times S-360960\times B-119840\times D+66507\times P-11.705\times T\times T-528.31\times S\times T-114130\times S\times S-59.505\times B\times T-22917\times$$

$$B\times S-222700\times B\times B+1114.6\times D\times T+239620\times D\times S993760\times D\times B1259500\times D\times D+78.542\times P\times T10912\times P\times S+29381\times P\times B-9684.1\times P\times D-3454.2\times P\times P,$$

wherein the Blue Record Maximum Density is less than or equal to an optical density of about 3.2, the Red Record Best Fit Slope is equal to or greater than about 0.18, and the Chrominance Area is maximized.

19. The method of claim 1, wherein the Blue Record Maximum Density is less than or equal to an optical density of about 3.1, Red Record Best Fit Slope is equal to or greater than about 0.2, Chrominance Area is maximized, and the development processing time at least about 20 seconds.

* * * * *